US011963570B2

(12) United States Patent
Pietrzak et al.

(10) Patent No.: US 11,963,570 B2
(45) Date of Patent: Apr. 23, 2024

(54) HELMET PAD

(71) Applicant: MIPS AB, Täby (SE)

(72) Inventors: Christopher Pietrzak, Täby (SE); Marcus Thiel, Täby (SE)

(73) Assignee: MIPS AB, Täby (SE)

( * ) Notice: Subject to any disclaimer, the term of this patent is extended or adjusted under 35 U.S.C. 154(b) by 295 days.

(21) Appl. No.: 17/285,538

(22) PCT Filed: Oct. 14, 2019

(86) PCT No.: PCT/EP2019/077797
§ 371 (c)(1),
(2) Date: Apr. 15, 2021

(87) PCT Pub. No.: WO2020/078913
PCT Pub. Date: Apr. 23, 2020

(65) Prior Publication Data

US 2021/0378345 A1 Dec. 9, 2021

(30) Foreign Application Priority Data

Oct. 16, 2018 (GB) ..... 1816832

(51) Int. Cl.
*A42B 3/06* (2006.01)
*A42B 3/12* (2006.01)

(52) U.S. Cl.
CPC ..... *A42B 3/127* (2013.01); *A42B 3/064* (2013.01)

(58) Field of Classification Search
CPC ..... A42B 3/127; A42B 3/064
See application file for complete search history.

(56) References Cited

U.S. PATENT DOCUMENTS

| | | | | |
|---|---|---|---|---|
| 6,701,535 | B2 * | 3/2004 | Dobbie | A42B 3/085 2/6.1 |
| 7,854,023 | B2 * | 12/2010 | Ando | A42B 3/328 2/424 |
| 8,863,319 | B2 * | 10/2014 | Knight | A42B 3/14 2/411 |
| 9,095,179 | B2 * | 8/2015 | Kwan | A42B 3/063 |
| 9,681,697 | B2 * | 6/2017 | Ikeda | A42B 3/142 |
| 11,229,254 | B1 * | 1/2022 | Matteucci | A42B 3/063 |
| 2011/0167532 | A1 | 7/2011 | Carlson et al. | |
| 2018/0027913 | A1 | 2/2018 | Thiel | |

FOREIGN PATENT DOCUMENTS

| | | | |
|---|---|---|---|
| CN | 105324048 | A | 2/2016 |
| CN | 105636469 | A | 6/2016 |
| CN | 107847003 | A | 3/2018 |
| JP | 6345444 | B2 | 6/2018 |

(Continued)

*Primary Examiner* — Tajash D Patel
(74) *Attorney, Agent, or Firm* — Husch Blackwell LLP

(57) ABSTRACT

A pad for mounting to a helmet, the pad comprising a support member, a first layer of material arranged to cover a first side of the support member and a second layer of material arranged to cover the first layer of material, wherein a low friction interface is arranged between the first layer of material and the second layer of material to enable sliding of the first layer of material relative to the second layer of material, wherein each layer of material is formed from at least one of a textile, a cloth, a fabric and a felt.

15 Claims, 5 Drawing Sheets

(56) References Cited

FOREIGN PATENT DOCUMENTS

| | | | | | |
|---|---|---|---|---|---|
| WO | 0145526 | A1 | | 6/2001 | |
| WO | 2011139224 | A1 | | 11/2011 | |
| WO | 2015/121787 | A1 | | 8/2015 | |
| WO | 2017151028 | A1 | | 9/2017 | |
| WO | 2018097785 | A1 | | 5/2018 | |
| WO | 2018183469 | A1 | | 10/2018 | |
| WO | WO-2021032347 | A1 | * | 2/2021 | ..... A42B 3/064 |
| WO | WO-2021260187 | A1 | * | 12/2021 | ..... A42B 3/064 |

* cited by examiner

HELMET PAD

RELATED APPLICATIONS

This application is a 35 USC § 371 National Stage application of International Application No. PCT/EP2019/077797, entitled "HELMET PAD," filed on Oct. 14, 2019, which claims the benefit of United Kingdom Patent Application No. 1816832.8, filed on Oct. 16, 2018, the disclosure of which is incorporated herein by reference in its entirety.

The present invention relates to a pad which may be mounted within a helmet.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets are used in ice hockey, cycling, motorcycling, motor-car racing, skiing, snow-boarding, skating, skateboarding, equestrian activities, American football, baseball, rugby, soccer, cricket, lacrosse, climbing, airsoft and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called a liner. That said, some helmets do not have a hard outer shell, for example rugby scrum caps. In any case, nowadays, a protective helmet has to be designed so as to satisfy certain legal requirements which relate to, inter alia, the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotational energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include Mild Traumatic Brain Injuries (MTBI) such as concussion, and more severe traumatic brain injuries such as subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either concussion, SDH, DAI or a combination of these injuries can be suffered. Generally speaking, SDH occur in the case of accelerations of short duration and great amplitude, while DAI occur in the case of longer and more widespread acceleration loads.

It is therefore desirable to provide a pad which may be mounted on a helmet that may at least partially improve the performance of a helmet in the event of an oblique impact.

According to an aspect of the present invention, there is provided a pad for mounting on a helmet, the pad comprising one or more of a support member, a first layer of material arranged to cover a first side of the support member and a second layer of material arranged to cover the first layer of material, wherein a low friction interface is arranged between the first layer of material and the second layer of material to enable sliding of the first layer of material relative to the second layer of material, wherein each layer of material is formed from at least one of a textile, a cloth, a fabric and a felt.

Optionally, the support member is an energy absorbing layer.

Optionally, the first layer of material and the second layer of material are arranged such that the grains of the first layer of material and the second layer of material are perpendicular.

Optionally, the pad further comprises a third layer of material arranged to cover a second side of the support member, wherein the second side is opposite to the first side of the support member;

wherein a peripheral region of the first layer of material is attached to the third layer of material.

Optionally, the pad further comprises a third layer of material arranged to cover a second side of the support member, wherein the second side is opposite to the first side of the support member;

wherein a peripheral region of the second layer of material is attached to the third layer of material.

Optionally, a peripheral region of both of the first layer of material and the second layer of material is attached to the third layer of material.

Optionally, the pad further comprises a layer of padding arranged between the support member and the first layer of material.

Optionally, the support member is rigid.

According to a second aspect of the present invention, there is provided a helmet comprising a first pad according to the first aspect of the present invention mounted to the helmet.

Optionally, the first pad is mounted inside of the helmet such that the helmet is arranged on the second side of the support member.

Optionally, the helmet further comprises a shell and the first pad is mounted inside of the shell such that the shell is arranged on the second side of the support member.

Optionally, the helmet further comprises an energy absorbing layer mounted inside of the shell and the first pad is mounted inside of the energy absorbing layer such that the energy absorbing layer is arranged on the second side of the support member.

Optionally, the first pad is arranged such that the interior of the helmet is on the second side of the support member.

Optionally, the helmet further comprises an energy absorbing layer; and the first pad is mounted outside of the energy absorbing layer such that the energy absorbing layer is arranged on the second side of the support member.

Optionally, the helmet further comprises a second pad according to the first aspect of the present invention mounted to the helmet, wherein the first pad is separate from the second pad.

According to a third aspect of the present invention, there is provided a method of assembling a pad for mounting inside of a helmet, the method comprising one or more of arranging a first layer of material to cover a first side of the support member and arranging a second layer of material to cover the first layer of material, wherein a low friction interface is present between the first layer of material and the second layer of material to enable sliding of the first layer of material relative to the second layer of material.

According to a fourth aspect of the present invention, there is provided a method of manufacturing a helmet, the method comprising one or more of manufacturing a pad according to the third aspect of the present invention and mounting the assembled pad to the helmet.

The invention is described below by way of non-limiting examples, with reference to the accompanying drawings, in which.

Figure 1:
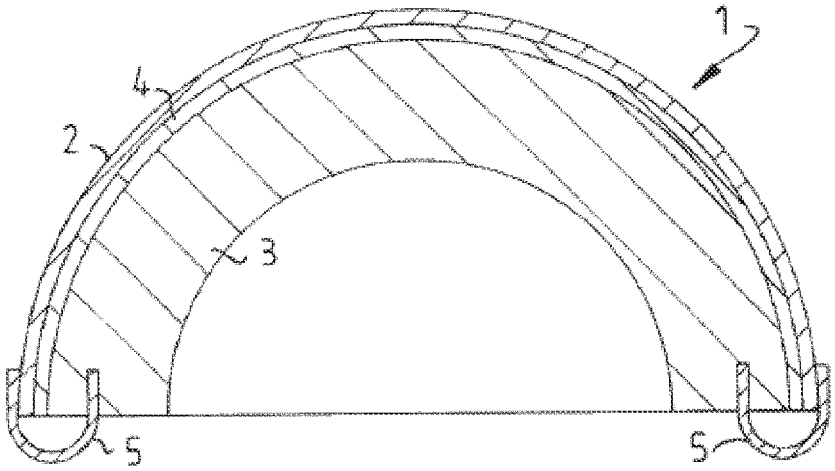
FIG. 1 depicts a cross section through a helmet for providing protection against oblique impacts.

The proportions of the thicknesses of the various layers and spacing between the layers in the helmets depicted in the figures have been exaggerated in the drawings for the sake of clarity and can of course be adapted according to need and requirements.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3. An additional attachment device may be provided that is intended for contact with the head of the wearer.

Arranged between the outer shell 2 and the inner shell 3 is an intermediate layer 4 or a sliding facilitator, and thus makes possible displacement between the outer shell 2 and the inner shell 3. In particular, as discussed below, an intermediate layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer or sliding facilitator such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connecting members 5 may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied. For example, the connecting members may be positioned away from the edge portion, and connect the outer shell 2 and the inner shell 3 through the intermediate layer 4

The outer shell 2 may be relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre, Kevlar or ultrahigh molecular weight polyethylene (UHMWPE).

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names Poron™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extend (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the intermediate layer 4 or sliding facilitator, for example oil, gel, Teflon, microspheres, air, rubber, polycarbonate (PC), a fabric material such as felt, etc. Such a layer may have a thickness of roughly 0.1-5 mm, but other thicknesses can also be used, depending on the material selected and the performance desired. A layer of low friction plastics material such as PC is preferable for the intermediate layer 4. This may be moulded to the inside surface of the outer shell 2 (or more generally the inside surface of whichever layer it is directly radially inward of), or moulded to the outer surface of the inner shell 3 (or more generally the outside surface of whichever layer it is directly radially outward of). The number of intermediate layers and their positioning can also be varied, and an example of this is discussed below (with reference to FIG. 3B).

As connecting members 5, use can be made of, for example, deformable strips of rubber, plastic or metal. These may be anchored in the outer shell and the inner shell in a suitable manner.

Figure 2:
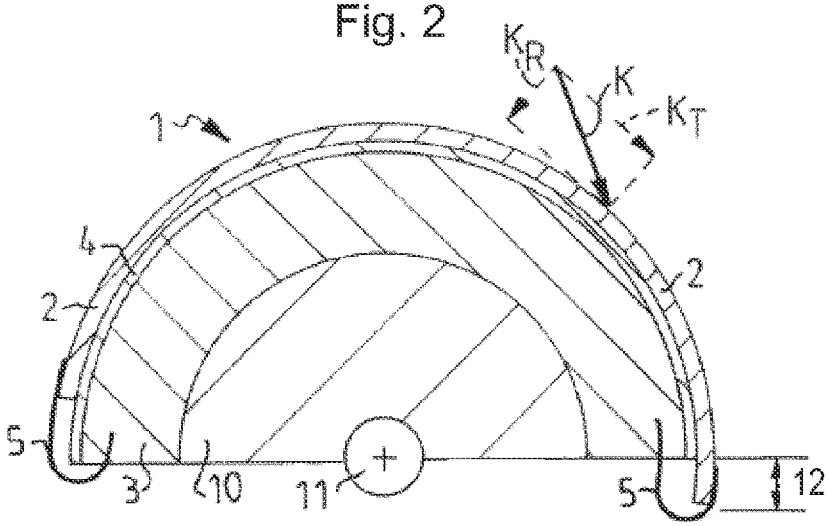
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force $K_T$ and a radial force $K_R$ against the protective helmet 1. In this particular context, only the helmet-rotating tangential force $K_T$ and its effect are of interest.

As can be seen, the force K gives rise to a displacement 12 of the outer shell 2 relative to the inner shell 3, the connecting members 5 being deformed. A reduction in the torsional force transmitted to the skull 10 of up to around 75%, and on average roughly 25% can be obtained with such an arrangement. This is a result of the sliding motion between the inner shell 3 and the outer shell 2 reducing the amount of rotational energy otherwise transferred to the brain.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3). Although FIG. 2 shows the intermediate layer 4 remaining fixed relative to the inner shell 3 while the outer shell slides, alternatively, the intermediate layer 4 may remain fixed relative to the outer shell 2 while the inner shell 3 slides relative to the intermediate layer 4. Alternatively still, both the outer shell 2 and inner shell 3 may slide relative to the intermediate layer 4.

Figure 3A:
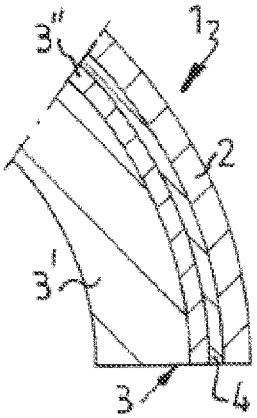
FIGS. 3A, 3B & 3C show variations of the structure of the helmet of FIG. 1.
Figure 3B:
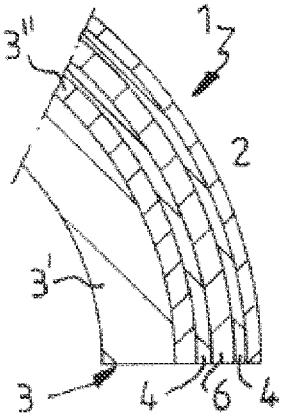
Figure 3C:
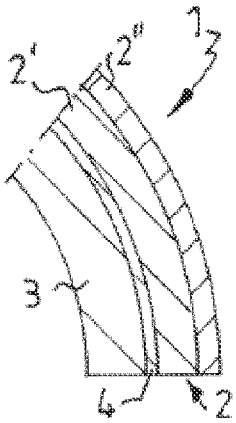

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" may be harder than the inner layer 3', to help facilitate the sliding with respect to outer shell 2. In FIG. 3*b*, the inner shell 3 is constructed in the same manner as in FIG. 3*a*. In this case, however, there are two intermediate layers 4, between which there is an intermediate shell 6. The two intermediate layers 4 can, if so desired, be embodied differently and made of different materials. One possibility, for example, is to have lower friction in the outer intermediate layer than in the inner. In FIG. 3*c*, the outer shell 2 is embodied differently to previously. In this case, a harder outer layer 2" covers a softer inner layer 2'. The inner layer 2' may, for example, be the same material as the inner shell 3. Although, FIGS. 1 to 3 show no separation in a radial direction between the layers, there may be some separation between layers, such that a space is provided, in particular between layers configured to slide relative to each other.

Figure 4:
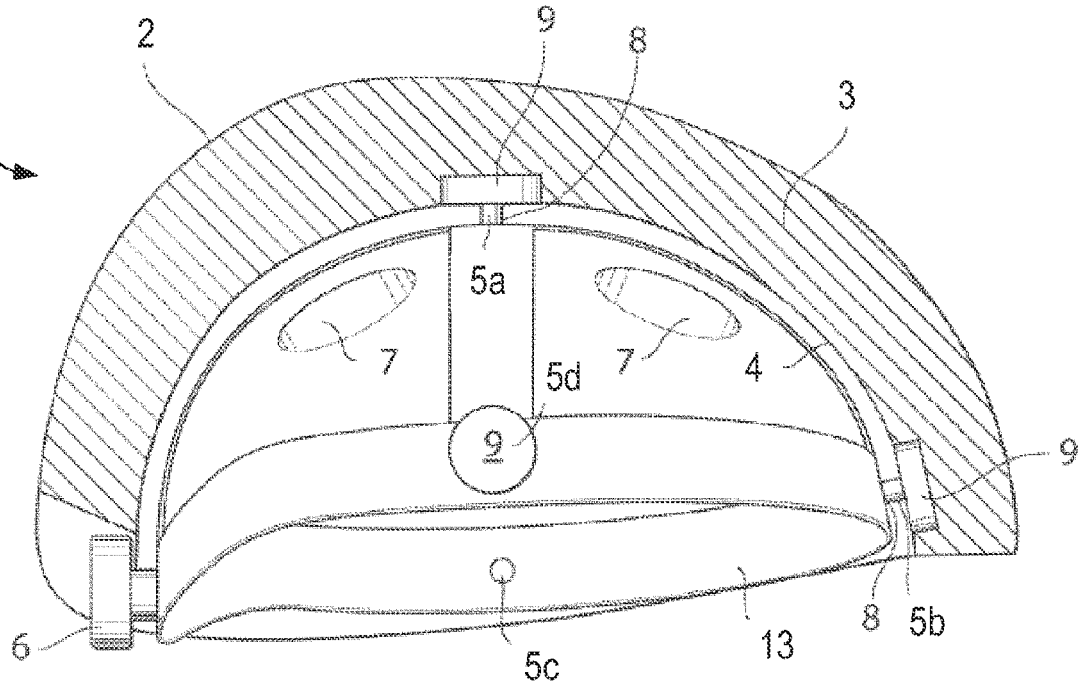
FIG. 4 is a schematic drawing of a another protective helmet.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An attachment device 13 is provided, for attachment of the helmet 1 to a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 may be a material having a low coefficient of friction, or may be coated with such a material.

As such, in the FIG. 4 helmet, the sliding facilitator may be provided on or integrated with the innermost sided of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 5 and may comprise a low friction material.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, ABS, PVC, PC, Nylon, PFA, EEP, PE and UHMWPE, or a powder material which could be infused with a lubricant. The low friction material could be a fabric material. As discussed, this low friction material could be applied to either one, or both of the sliding facilitator and the energy absorbing layer The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the embodiment shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

Figure 5:
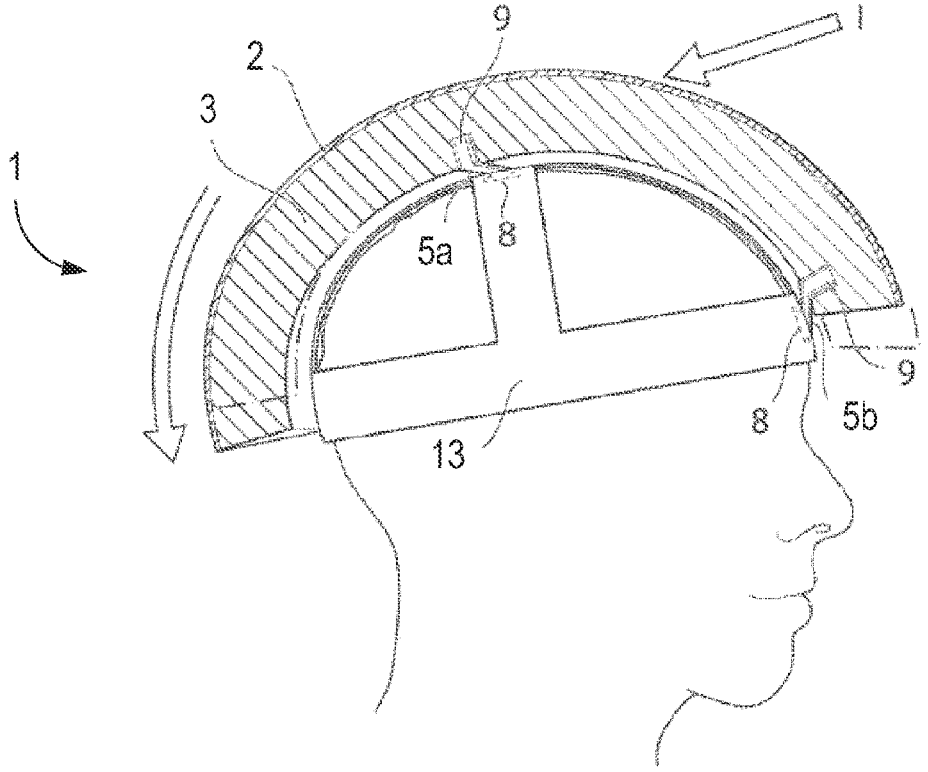
FIG. 5 depicts an alternative way of connecting the attachment device of the helmet of FIG. 4

FIG. 5 shows an embodiment of a helmet similar to the helmet in FIG. 4, when placed on a wearers' head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members 5 deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries including MTBI and more severe traumatic brain injuries such as subdural haematomas, SDH, blood vessel rapturing, concussions and DAI is thereby reduced.

In an arrangement according to the present invention, discussed in further detail below, a pad may be mounted to a helmet. The helmet may have at least one of an energy absorbing layer and a relatively hard layer formed outward of the energy absorbing layer. It should be understood that such a pad may be added to any helmet according to any of the arrangements discussed above, namely having a sliding interface between at least two of the layers of the helmet. However, the features of helmets such as those discussed above are not essential to the present invention. The pad may also be used in other devices that provide impact protection, such as body armour or padding for sports equipment.

Figure 6:
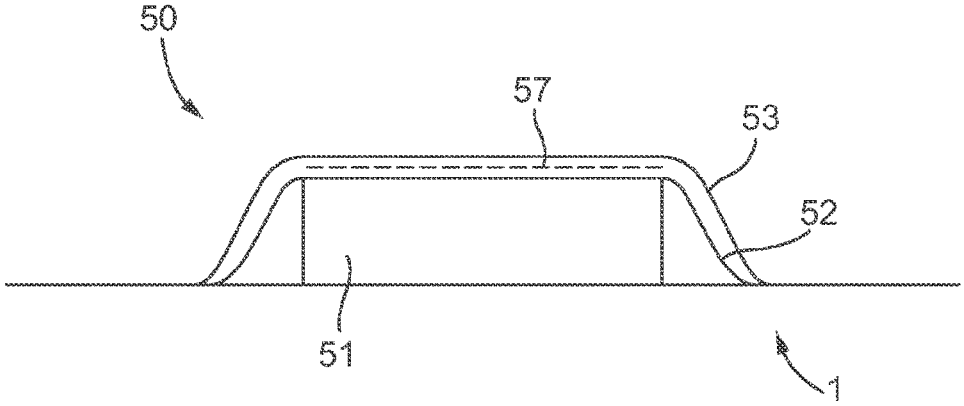
FIG. 6 depicts, in cross-section, a pad according to an embodiment of the present invention.

FIG. 6 shows a pad 50 according to the present invention. The pad 50 comprises a support member 51, a first layer of material 52 covering a first side of the support member 51 and a second layer of material 53 covering the first layer of material 52. A low friction interface 57 is arranged between the first layer of material 52 and the second layer of material 53 to enable sliding of the first layer of material relative to the second layer of material 52. The components of the pad 50 will be described in more detail below.

In use, the pad 50 may be mounted to a helmet 1. In the example shown in FIG. 1, the support member 51 is attached directly to a surface of the helmet 1. The surface may be an inside or an outside surface of the helmet 1. The helmet 1 may comprise the pad 50. Further details of the helmet 1 will be discussed in more detail below.

When a user is wearing the helmet 1, in the case where the pad 50 is mounted on the inside of the helmet 1, the second layer of material 53 may be in contact with the user's head. The size or shape of the helmet 1 may cause the second layer of material 53 to be pressed against the head of the user, thereby causing the pad 50 and thus the helmet 1 to be secured against the head of the user.

During an oblique impact to the helmet 1, a rotational force in the helmet 1 may be created. The low friction interface 57 between the first 52 and second 53 layer of material allows sliding to occur between the first 52 and second 53 layer of material and thus relative motion between the helmet 1 and the head of the user to take place. This allows for a controlled way to dissipate energy that would otherwise be transmitted as rotational energy to the brain.

In the case where the pad 50 is mounted on the outside of the helmet 1, during an oblique impact to the pad 50, a rotational force in the second layer of material 53 may be created. The low friction interface 57 between the first 52 and second 53 layer of material allows sliding to occur between the first 52 and second 53 layer of material and thus relative motion between the first 52 and second 53 layer of material to take place. This allows for a controlled way to dissipate energy that would otherwise be transmitted as rotational energy to the brain.

The reduced energy transmission discussed above results in reduced rotational acceleration affecting the brain, thus reducing the rotation of the brain within the skull. The risk of rotational injuries including MTBI and STBI such as subdural haematomas, SDH, blood vessel rapturing, concussions and DAI is thereby reduced.

The support member 51 forms the body of the pad 50. The support member 51 may separate the first layer of material 52 from the surface that the pad 50 is mounted to.

The support member 51 may act as an energy absorbing layer. In this case, the support member is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names Poron™ and D3O™.

The support member 51 may act as comfort padding. In this case, although the support member 51 may absorb some energy in an impact, the support member 51 may not absorb a significant proportion of the energy of an impact in comparison with the case where the support member 51 acts as an energy absorbing layer. The support member 51 may comprise soft foams, felt or other cushioning materials.

The support member 51 may be solid, in that the support member 51 may comprise a continuous or uninterrupted inner structure. Alternatively, the support member 51 may comprise at least one hollow portion. The hollow portion may be filed with air or any other suitable gas.

The support member 51 may be rigid, in that the support member 51 does not substantially deform when a user puts on the helmet 1 and/or during an impact to the helmet 1. The support member 51 may comprise multiple layers, which may provide different functions. For example, the support member 51 may comprise one or more of a support layer, and energy absorbing layer and a comfort padding layer. Each of these layers may be formed from suitable materials as discussed above.

In the examples shown in the figures, the cross-section of the support member 51 is shown to be rectangular. However, the support member 51 may be of any shape or cross-section that allows a low friction interface 57 to be formed between the first 52 and second 53 layer of material. For example, the support member 51 may be shaped as a disk or a square. The edges of the support member 51 may be sloped.

The support member 51 may be permanently attached to the surface of the helmet 1 using adhesive or another method of permanent attachment. Alternatively, the support member 51 may be attached to the surface of the helmet using a detachable attachment method such as one or more of Velcro, a mechanical snap fit or a clip. The first 52 and second 53 layers of material may also be attached to the surface of the helmet using adhesive or another method of permanent attachment, or by a detachable method such as Velcro.

Alternatively, the support member 51 may not be attached to the surface of the helmet 1. In this case, the support member 51 is floating or free to move within the space defined by the surface of the helmet 1 and the first layer of material 52. A low friction interface may also be formed between the surface of the helmet 1 and the support member 51.

At least one of the first layer of material 52 and the second layer of material 53 may be formed from at least one of a textile, a cloth, a fabric and a felt. The layers may be formed from a woven material. The first 52 and second 53 layer of material may both be formed from the same material or the layers may be formed from different materials. The material forming each of the first 52 and second 53 layers of material may have grain defined by the orientation and/or the texture of the fibres forming the layer of material.

When the helmet 1 in which the pad 50 may be mounted on or incorporated in is worn by a user, the second layer of material 53 may be held against the head of the user by the structure of the pad. The frictional force between the outer surface of the second layer of material 53 and the user's head may hold the helmet in place during normal use. During an impact, the frictional force between the outer surface of the second layer of material 53 and the user's head may prevent relative motion between the outer surface of the second layer of material 53 and the user's head. The first layer of material 52 may move horizontally relative to the second layer of material 53. Each of the layers of material may be elastic to allow horizontal motion of the first layer of material 52 relative to the second layer of material 53 when either of the first 52 or second 53 layers of material are attached to other parts of the pad 50 and/or the helmet. The elasticity of either or both of the first 52 or second 53 layers of material may be selected to provide a desired amount of relative horizontal movement between the first 52 and second 53 layers.

The low friction interface 57 may be provided between the opposing surfaces of the first layer of material 52 and the second layer of material 53. In this context, a low friction interface may be configured such that sliding contact is still possible even under the loading that may be expected in use. In the context of a helmet, for example, it may be desirable for sliding to be maintained in the event of an impact that is expected to be survivable for the wearer of the helmet. This may be provided, for example, by the provision of an interface between the two surfaces at which the coefficient of friction is between 0.001 and 0.3 and/or below 0.15.

In an example of one method of forming the low friction interface 57, the first layer of material 52 and the second layer of material 53 may be arranged such that the grains of the first layer of material 52 and the second layer of material 52 are perpendicular. The interaction between the surfaces of the layers of material when the grains are arranged at 90 degrees to each other may result in a lower coefficient of friction than when the grains are arranged parallel to each other.

One suitable type of material that may be used as the first layer of material 52 and the second layer of material 53 to form the low friction interface 57 is a tricot fabric. For example, a three-bar tricot fabric consisting of 85% 40-denier semi dull nylon and/or 15% 140-denier spandex may be used as one of, or optionally both, the first layer of material 52 and the second layer of material 53. Tricot knit fabric may be made of materials including, at least one of, cotton, wool, silk, rayon, nylon, and combinations thereof. A tricot fabric may mean a plain warp-knit fabric (such as nylon, wool, rayon, silk, or cotton) that is a close-knit design with fibres running lengthwise while employing an inter-loop yarn pattern. The close-knit design may be substantially inelastic. The yarn may zigzag vertically, following a single column or wale of knitting. One side of the tricot fabric may feature fine ribs running in the length-wise direction while the other side features ribs that run in the cross-wise direction.

Tricot fabric may appear to have a shiny side and an opposite side that is duller. When the shiny sides of two pieces of tricot fabric are placed face-to-face and the two pieces of fabric are oriented such that the machine direction of manufacture of each piece of fabric is arranged to be substantially perpendicular to that of the other piece, the interface between the two pieces of fabric demonstrates a very low coefficient of friction. The machine direction may be defined as that direction in which the fabric, when made, moves forward through a knitting machine. The machine orientation may be defined as the grain of the fabric. A substantially perpendicular orientation of the machine direction of the fabrics produces an interface that has a lower coefficient of friction than if the pieces of fabric were positioned such that the machine direction were substantially parallel. The low friction interface 57 may therefore be formed using two layers of tricot material arranged as discussed above as the first later of material 52 and the second layer of material 53. When a user is wearing the helmet 1 including a pad 50 with layers formed in this way, the layers may slide out of a perpendicular relationship while the helmet 1 is worn and/or during an impact to the helmet 1 and/or the pad 50. The low friction interface 57 may be maintained when the layers are not orientated precisely perpendicular to each other. However, the more perpendicular the orientation, the lower the coefficient of friction of the interface may be.

Alternatively or additionally, a further layer of material may be provided between the first layer of material 52 and the second layer of material 53 to form a low friction interface 57 between the further layer and the first layer of material 52 and/or the further layer and the second layer of material 53. For example, any of the materials or techniques discussed above as suitable for forming the intermediate layer or sliding facilitator 4 may be used. Alternatively or additionally, the low friction interface 57 may be provided, for example, by coating a least one of the opposing surfaces of the first layer of material 52 and the second layer of material 53 with a material which decreases the friction between the two layers of material.

Figure 7:
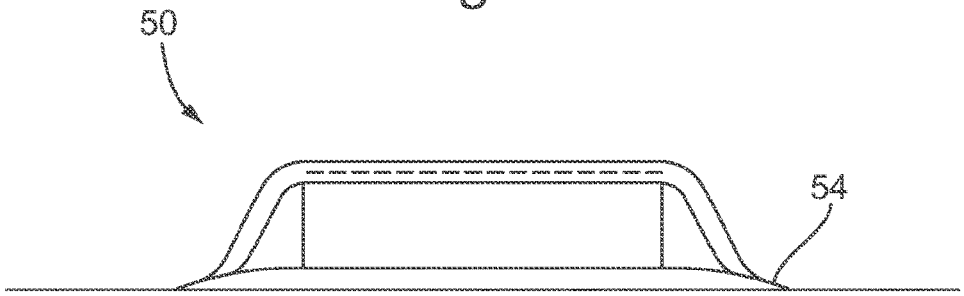
FIG. 7 depicts. in cross-section, a pad according to another embodiment of the present invention.

The pad 50 may further comprise a third layer of material 54 arranged to cover a second side of the support member 51, wherein the second side is opposite to the first side of the support member 51. An example of a pad 50 including a third layer of material 54 is shown in FIG. 7. Any features of the pad 50 not described may be assumed to be the same as the features of the pad 50 described above. The third layer of material 54 may be formed from at least one of a textile, a cloth, a fabric and a felt. The third layer of material 54 may be formed of the same material as the first 52 and/or second 53 layer of material, or the third layer of material 54 may be formed of a different material.

The third layer of material 54 may be attached to the surface of the helmet 1 using adhesive or any other permanent attachment method. Alternatively, the third layer of material 54 may be attached to the surface of the helmet 11 by a detachable method such as Velcro. The helmet 1 may comprise the third layer of material 54.

Figure 8:
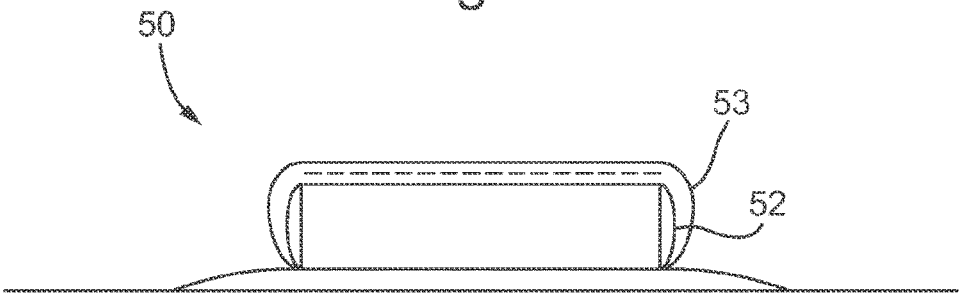
FIG. 8 depicts, in cross-section, a pad according to another embodiment of the present invention.

A peripheral region of the first layer of material 52 and/or a peripheral region of the second layer of material 53 may be attached to the third layer of material 24. The region where the first 52 and/or second 53 layer of material is attached to the third layer of material 54 may be a peripheral region of the first 52 and/or second 53 layer of material. The first layer of material 52 may be attached to the second layer of material 53 in the peripheral region. The attachment of any of the layers of material may be made under the second side of the support member 51. An example of this arrangement is shown in FIG. 8. Arranging the pad 50 in this way may simplify the fabrication of the pad 50.

The layers of material may be attached using methods typically used to attach layers of fabric together, such as stitching or adhesive. The layers of material may also be attached by the use of a layer of plastic to heat seal or weld the layers of material together.

The support member 51 may be attached to the third layer of material 54 or the support member 51 may be free to move inside the pocket or space defined by the first layer of material 51 and the third layer of material 54. In the case where the support member 51 is detached from the third layer of material 54, a low friction interface may be arranged between the support member 51 and the third layer of material 54 to enable sliding of the support member 51 relative to the third layer of material 54. The low friction interface may be formed in any of the ways of forming a low friction interface 57 between the first layer of material 52 and second layer of material 53 discussed above. A low friction interface arranged between the support member 51 and the third layer of material 54 may assist with the controlled dissipation of energy that would otherwise be transmitted as rotational energy to the brain as discussed above.

Figure 9:
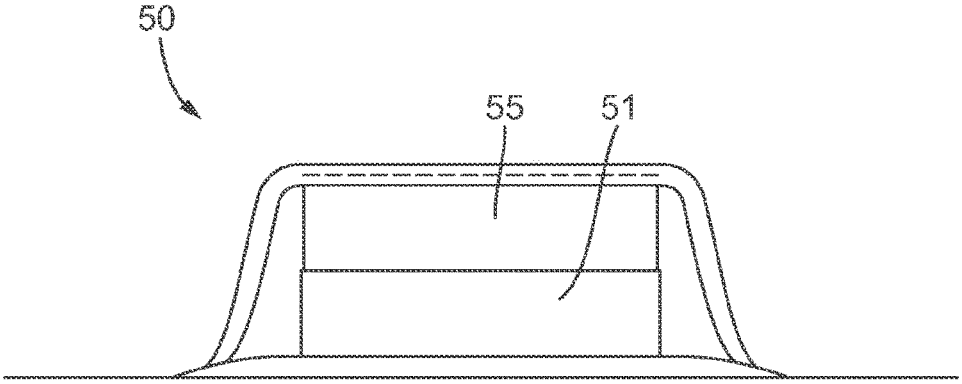
FIG. 9 depicts, in cross-section, a pad according to another embodiment of the present invention.

The pad 50 may further comprise a layer of padding 55 arranged between the support member 51 and the first layer of material 52. An example of a pad including a layer of padding 55 is shown in FIG. 9. The padding 55 may be attached to the first side of the support member 51 and/or the first layer of material 52. The padding 55 may act as comfort padding to make a helmet including the pad 50 more comfortable to wear by compression of the padding 55 when the pad 50 is pressed against the user's head in the case where the pad 50 is mounted on the inside of the helmet 1.

The pad 50 described above may be mounted to a helmet 1. The pad 50 may be mounted on the inside or the outside of the helmet 1. The helmet 1 may comprise at least one hard layer and therefore be rigid. Examples of such helmets include military helmets or protective helmets for use on building sites. Alternatively, the helmet 1 may comprise only soft layers and therefore be flexible. Examples of such helmets includes protective caps worn while participating in sports such as rugby, soccer or boxing and includes scrum caps.

Figure 10:
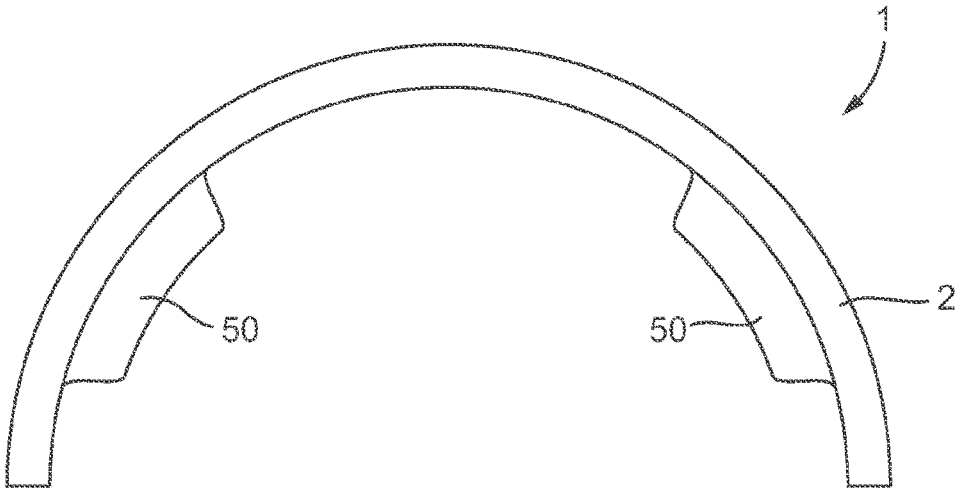
FIG. 10 depicts, in cross-section, a helmet according to an embodiment of the present invention.

FIG. 10 shows an example a helmet 1 according to the present invention where the pad 50 is mounted to the inside of the helmet 1. The helmet 1 comprises an outer shell 2 and the pad 50 mounted inside of the outer shell 2. The pad 50 may be mounted in the helmet 1 such that the helmet 1 is arranged on the second side of the support member 51 of the pad 50. This arrangement may result in the low friction interface 57 between the first layer of material 52 and the second layer of material 53 being arranged on the opposite side of the support member 51 to the helmet 1. This arrangement may further result in the low friction interface 57 being arranged on the opposite side of the support member 51 to the outer shell 2. The pad 50 may be mounted directly to the outer shell 2 or the pad may be mounted directly to a further layer or component of the helmet 1 arranged inside of the outer shell 2. For example, the pad 50 may be attached to an energy absorbing layer or a liner within the helmet 1.

A further pad 50 may be mounted to the helmet 1, where the further pad 50 may be arranged separately from the first pad 50. The pads 50 being arranged separately to each other may mean that none of the components of the pad 50 discussed above are shared between the separate pads 50. The pads 50 being separate may mean that the pads are not directly attached together. The pads 50 being arranged separately may mean that the components forming one of the pads 50 do not overlap with the components forming the other pad 50. Further pads 50 may be mounted to the helmet 1. When a plurality of the pads 50 are mounted on the inside of the helmet 1, the pads 50 may be arranged and/or spaced throughout the inside of the helmet 1 to provide a comfortable fit to a user of the helmet 1. The pads 50 may be spaced at regular intervals around the inside of the helmet 1.

Figure 11:
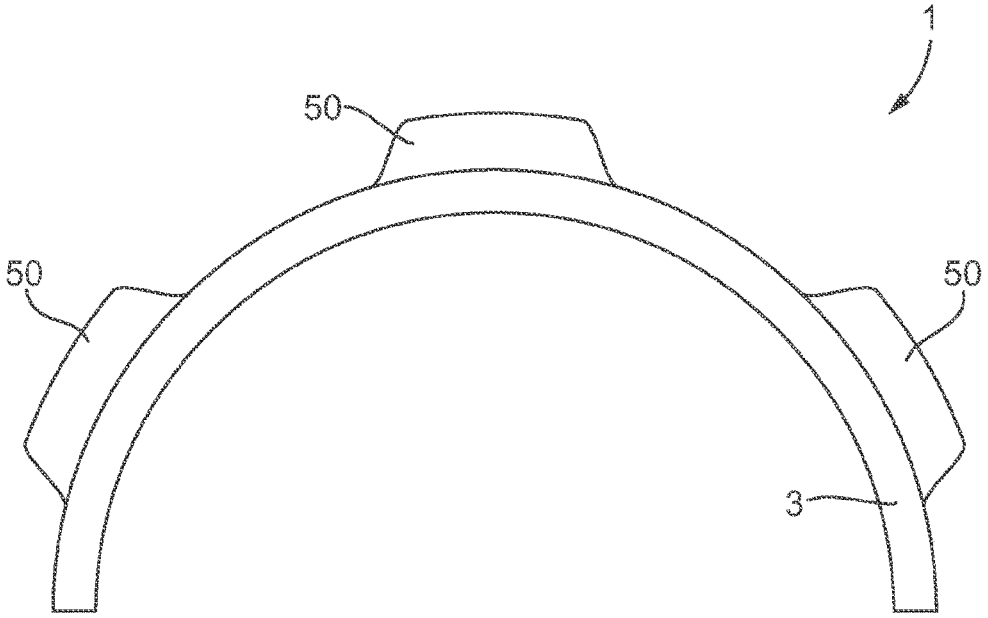
FIG. 11 depicts, in cross-section, a helmet according to another embodiment of the present invention.

FIG. 11 shows an example a helmet 1 according to the present invention where a pad 50 is mounted to the outside of the helmet 1. The helmet 1 in this example does not include an outer shell 2. The helmet 1 in this example comprises, for example, an energy absorbing layer or inner shell 3. However, the helmet 1 may only comprise a soft or flexible layer. In this arrangement, the pad 50 may be arranged such that the interior of the helmet 1 is on the second side of the support member 51 of the pad 50. This arrangement results in the low friction interface 57 between the first layer of material 52 and the second layer of material 53 being arranged on the opposite side of the support member 51 to the head of a user of the helmet 1. This may make the helmet 1 feel more secure on the user's head, because the low friction interface 57 is not so close to the user's head as when the low friction interface 57 is arranged on the same side of the support member 51 as the head. This arrangement may result in the low friction interface 57 being mounted on the outside of the energy absorbing layer or inner shell 3, if present. A plurality of pads 50 may be mounted to the helmet 1. When a plurality of the pads 50 are mounted on the inside of the helmet 1, the pads 50 may be arranged and/or spaced on the outside of the helmet 1 to provide protection against impacts from a variety of directions to a user of the helmet 1. The plurality of pads 50 may cover the majority of the outer surface of the helmet 1. In the case where the helmet 1 comprises the pads 50, the helmet 1 may be substantially formed from the plurality of pads, in that the majority of the surface and/or body of the helmet 1 is formed by the pads 50.

Examples of helmets 1 in which the pad 50 may be mounted on the outside of the helmet 1 include protective helmets for use in sport such as rugby and soccer or scrum caps.

A method of assembling a pad 50 as discussed above for mounting inside to a helmet 1 comprises arranging a first layer of material 52 to cover a first side of a support member 51 and arranging a second layer of material 53 to cover the first layer of material 52, wherein a low friction interface 57 is present between the first layer of material 52 and the second layer of material 53 to enable sliding of the first layer of material 52 relative to the second layer of material 53. The components mentioned above may be assembled in any order. For example, the first layer of material 52 may be attached to the second layer of material 53 before the layers are arranged on top of the support member 51. The pad 50 may be assembled within a helmet 1. For example, the support member 51 may be attached to a surface of the helmet 1 and the other layers of material may subsequently be arranged on top of the support member 51 and attached to the helmet 1. Alternatively, the pad 50 may be fully assembled and subsequently the pad 50 may be mounted to the helmet.

When the pad 50 includes the third layer of material 54, the first layer of material 52 and the second layer of material 53 may initially be attached to the third layer of material 54. The support member 51 and any further components of the pad 50 may then be inserted into the pocket formed by the first layer of material 52 and the third layer of material 54. Alternatively, the support member 51 may be attached to the third layer of material 54 and the first 52 and second 53 layers of material may be arranged on the support member 21 and attached to the third layer of material 54.

As described above, the components of the pad 50 may be attached together using a suitable attachment method such as stitching, adhesive or heat sealing. The method may additionally comprise incorporating any of the further components of the pad 50 discussed above into the pad 50.

The pad 50 may be mounted to the helmet 1 after the helmet 1 has been fabricated. Alternatively, the pad 50 may be mounted to a layer of the helmet 1 and subsequent layers may be attached or deposited on the layer to form the helmet 1.

The pad 50 may be formed as part of the helmet fabrication process. For example, a composite sheet may be used to form a helmet 1. The composite sheet may be a sheet formed from a plurality of layers of material. The composite sheet may comprise at least one of a layer made of a material suitable for forming the first layer of material 52, a layer made of a material suitable for forming the second layer of material 53, a layer made of a material suitable for forming the support member 51 and a layer made of a material suitable for forming the third layer of material 54. The composite sheet may then be pressed and/or heated under a mold to form a plurality of pads 50 as described above in the sheet. The layers of material forming the composite sheet need not be connected in any way before they are pressed and/or heated to form the pads 50. Sections of the molded sheet which includes the plurality of pads 50 may be cut to produce a helmet 1 on which the pads 50 are mounted. In this example, the helmet 1 comprises the pads 50.

The invention claimed is:

1. A pad for mounting to a helmet, the pad comprising:
- a support member forming a body of the pad;
- a first layer of material arranged to cover a first side of the support member; and
- a second layer of material arranged to cover the first layer of material, such that the first layer of material is between the second layer of material and the support member; wherein
- a low friction interface is arranged between the first layer of material and the second layer of material to enable sliding of the first layer of material relative to the second layer of material during an impact to the helmet;
- each layer of material is formed from at least one of a textile, a cloth, and a fabric, with a material forming each of the first and second layers of material having a grain defined by the orientation and/or the texture of the fibers forming the layer of material and
- the low friction interface is formed by the first layer of material and the second layer of material being arranged such that the grains of the first layer of material and the second layer of material are perpendicular.

2. The pad of claim 1, wherein the support member is an energy absorbing layer.

3. The pad of claim 1, further comprising a third layer of material arranged to cover a second side of the support member, wherein the second side is opposite to the first side of the support member;
- wherein a peripheral region of the first layer of material is attached to the third layer of material.

4. The pad of claim 1, further comprising a third layer of material arranged to cover a second side of the support member, wherein the second side is opposite to the first side of the support member;
- wherein a peripheral region of the second layer of material is attached to the third layer of material.

5. The pad of claim 3, wherein a peripheral region of both of the first layer of material and the second layer of material is attached to the third layer of material.

6. The pad of claim 1, further comprising a layer of padding arranged between the support member and the first layer of material.

7. The pad of claim 1, wherein the support member is rigid.

8. A helmet comprising a first pad according to claim 1 mounted to the helmet.

9. The helmet of claim 8, wherein the first pad is mounted inside of the helmet such that the helmet is arranged on the second side of the support member.

10. The helmet of claim 9, wherein the helmet further comprises a shell; and
- the first pad is mounted inside of the shell such that the shell is arranged on the second side of the support member.

11. The helmet of claim 9, wherein the helmet further comprises an energy absorbing layer mounted inside of the shell; and the first pad is mounted inside of the energy absorbing layer such that the energy absorbing layer is arranged on the second side of the support member.

12. The helmet of claim 8, wherein the first pad is arranged such that an interior of the helmet is on the second side of the support member.

13. The helmet of claim 12, further comprising an energy absorbing layer; and the first pad is mounted outside of the energy absorbing layer such that the energy absorbing layer is arranged on the second side of the support member.

14. The helmet of claim 8, further comprising a second pad according to claim 1 mounted to the helmet; wherein the first pad is separate from the second pad.

15. A method of manufacturing a helmet, the method comprising:

manufacturing a pad; and mounting the assembled pad to the helmet, wherein manufacturing the pad comprises:

arranging a first layer of material to cover a first side of a support member; and arranging a second layer of material to cover the first layer of material, such that the first layer of material is between the second layer of material and the support member; wherein a low friction interface is present between the first layer of material and the second layer of material to enable sliding of the first layer of material relative to the second layer of material during an impact to the helmet;

each layer of material is formed from at least one of a textile, a cloth, and a fabric, with a material forming each of the first and second layers of material having a grain defined by the orientation and/or the texture of the fibers forming the layer of material; and the low friction interface is formed by the first layer of material and the second layer of material being arranged such that the grains of the first layer of material and the second layer of material are perpendicular.

* * * * *